United States Patent [19]

Knapp, Jr.

[11] 4,048,609

[45] Sept. 13, 1977

[54] LATTICE STRUCTURE FOR ELECTRIC FUSES COMPRISING FUSIBLE ELEMENTS AND INSULATING SUPPORTS THEREFOR

[75] Inventor: Edward J. Knapp, Jr., Amesbury, Mass.

[73] Assignee: The Chase-Shawmut Company, Newburtport, Mass.

[21] Appl. No.: 658,736

[22] Filed: Feb. 17, 1976

[51] Int. Cl.[2] ..... H01H 85/04; H01H 85/14

[52] U.S. Cl. ..... 337/159; 337/227; 337/231; 337/295

[58] Field of Search ..... 337/159, 229, 280, 290, 337/292, 158, 227, 231, 233, 295

[56] References Cited

U.S. PATENT DOCUMENTS

| | | | |
|---|---|---|---|
| 2,892,061 | 6/1959 | Kozacka | 337/280 |
| 3,113,195 | 12/1963 | Kozacka | 337/229 X |
| 3,291,941 | 12/1966 | Salzer | 337/159 |
| 3,465,275 | 9/1969 | Swain | 337/158 |

*Primary Examiner*—Robert J. Hickey
*Attorney, Agent, or Firm*—Erwin Salzer

[57] ABSTRACT

An insulating support for fusible elements in ribbon form having points of drastically reduced cross-sectional area which reduces the dimensional stability of the fusible elements to such an extent that they are not capable of supporting themselves. The support consists of a strip of electric insulating material arranged in spaced relation from, and parallel to, the fusible element. The strip has a plurality of arms projecting transversely from the former. Each of said plurality of arms supports the fusible element at a region situated between points of drastically reduced cross-sectional area thereof.

5 Claims, 6 Drawing Figures

LATTICE STRUCTURE FOR ELECTRIC FUSES COMPRISING FUSIBLE ELEMENTS AND INSULATING SUPPORTS THEREFOR

BACKGROUND OF THE INVENTION

The melting $i^2.t$ and the peak of the let-through current of a current-limiting fuse depend primarily on the metal of which its fusible element or elements consist, and on the cross-sectional area of the points of smallest cross-sectional area of its fusible element, or elements. Since it is often necessary to minimize the melting $i^2.t$ and the peak of the let-through current, the point or points of smallest cross-sectional area of fusible elements must often be reduced to such an extent as to largely deprive the fusible elements of their dimensional stability. This makes it extremely difficult to handle the same, in particular to assemble the same with the other constituent parts of fuses, and to prevent damage to the points of minimal cross-sectional area, or necks, of such fusible elements.

Current-limiting fuses which have virtually point-shaped necks are disclosed in U.S. Pat. No. 2,665,348 to Frederick J. Kozacka; Jan. 5, 1954 for CURRENT-LIMITING FUSE. The above design is relatively complex and costly to manufacture, and it does not lend itself to applications wherein each fusible element must have a relatively large number of serially related points of drastically reduced cross-sectional area, and wherein a plurality of such elements must be combined in a single fuse structure. Another serious limitation of the above design consists in that there is no immediate physical engagement between the arc-extinguishing granular filler, or quartz sand, and the points of arc inception of the fusible element. Another limitation of the above design consists in that the granular arc-quenching filler is not in immediate physical engagement with the portions of the arc which result from the burnback of the fusible element.

Acceptance of these and other drawbacks in prior art current-limiting fuses were the price that had heretofore to be paid for drastic reduction of the cross-sectional area of the necks of the fusible elements thereof.

The present invention provides structures including fusible elements which have points of drastically reduced cross-sectional area and which fusible elements are not subject to the limitations of prior art fusible elements of this description.

SUMMARY OF THE INVENTION

The invention refers to lattice structures intended as components of electric fuses. The lattice structures comprise fusible elements and insulating supports therefor. To be more specific, a structure embodying this invention includes a fusible element in ribbon-form having a plurality of serially related points of drastically reduced cross-sectional area each formed by a pair of juxtaposed substantially V-shsped incisions. A structure embodying the invention further includes a substantially planar strip of electric insulating material arranged in spaced relation and substantially parallel to said fusible element, said strip having a plurality of arms projecting transversely therefrom and each supporting said fusible element at a region situated between said points of drastically reduced cross-sectional area.

DESCRIPTION OF PREFERRED EMBODIMENTS

Figure 1:
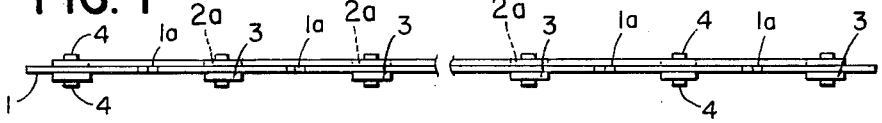
FIG. 1 is a side elevation of a first embodiment of the invention.
Figure 3:
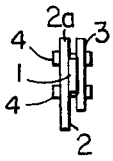
FIG. 3 is an end view of the structure of FIGS. 1 and 2 seen in the direction of the arrow R of FIG. 2.
Figure 2:
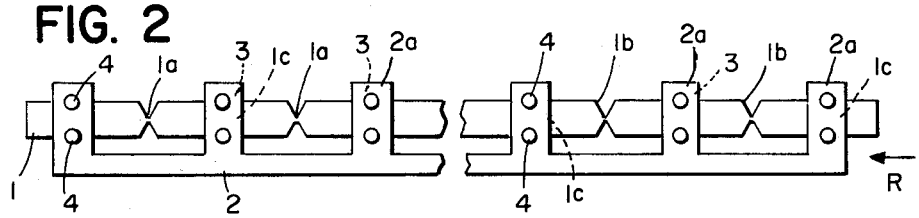
FIG. 2 is a top-plan view of the structure of FIG. 1.

Referring now to FIGS. 1–3 of the drawings, numeral 1 has been applied to indicate a straight fusible element in ribbon form having a plurality of serially related points 1*a* of drastically reduced cross-sectional area. Element 1 is preferably of sheet silver. Points 1*a* are formed by juxtaposed lateral substantially triangular incisions 1*b*. A substantially planar strip 2 of electric insulating material is arranged in space relation and substantially parallel to fusible element 1. Strip 2 has a plurality of arms 2*a* projecting transversely therefrom. Each arm 2*a* engages fusible element 1 at a region 1*c* situated between points 1*a* of drastically reduced cross-sectional area.

Points 1*a* of reduced cross-sectional area are spaced equidistantly from each other, and regions 1*c* of large cross-sectional area are also spaced equidistantly from each other.

Reference numeral 3 has been applied to indicate a plurality of clamping plates of which each is substantially coextensive with one of arms 2*a*. Fusible element 1 is sandwiched between arms 2*a* and clamping plates 3 at the regions 1*c* of fusible element 1. Arms 2*a* and clamping plates 3 are tied together by fasteners 4, e.g. by small eyelets.

Strip 2, arms 2*a* and clamping plates 3 are preferably of a melamine-glass-cloth laminate. Parts 2,2*a* and 3 form an effective brace for the extremely fragile fusible element 1. The ends of the latter may be inserted into grooves in the axially inner end surfaces of the terminal plugs of a fuse and soldered to the terminal plugs as is general practice in the art. See, for instance, U.S. Pat. No. 2,794,883 to F. J. Kozacka; June 4, 1957 for FUSE CONTACT STRUCTURES. The latter patent refers to a low voltage fuse having fusible elements which are relatively short and have necks of relatively large cross-sectional area. Because of these two reasons, the fusible elements shown in the above patent have a relatively high degree of dimensional stability.

When the structure of FIGS. 1–3 is mounted in a fuse, the preponderant length of fusible element 1 is in immediate contact with the granular arc-quenching filler inside the casing of the fuse. In case of burnback of the fusible element 1 close to parts 2*a* and 3, the latter evolve, if made of glass-cloth-melamine, nitrogen-rich blasts of arc extinguishing gas, minimizing the possibility that the portions of fusible element 1 sandwiched between parts 2*a* and 3 will be vaporized. Thus the multibreak feature of the structure with its multiple anode drops and multiple cathode drops will be maintained.

Strip 2 and arms 2*a* are preferably formed by an integral stamping.

Figure 4:
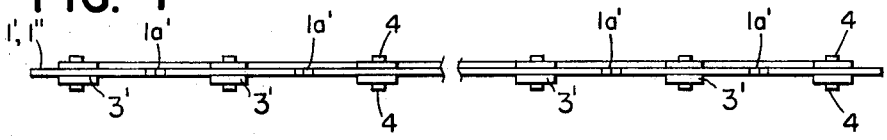
FIG. 4 is a side elevation of a second embodiment of the invention.
Figure 6:
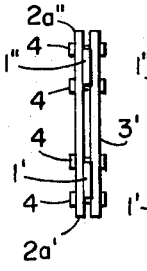
FIG. 6 is an end view of the structure of FIGS. 4 and 5 seen in the direction of the arrow S of FIG. 5.
Figure 5:
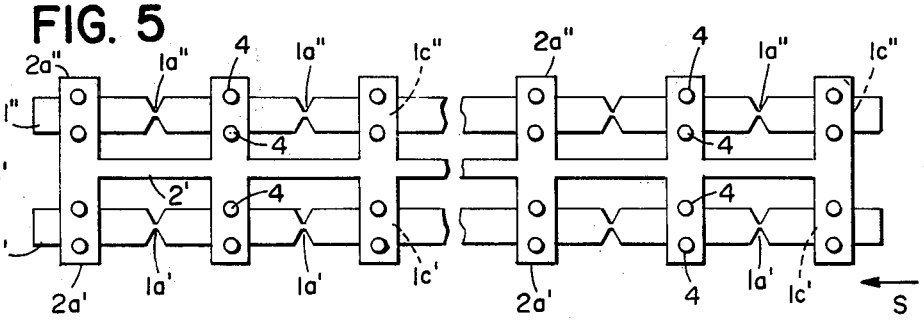
FIG. 5 is a top-plan view of the structure of FIG. 4.

FIGS. 4, 5 and 6 refer to a lattice structure including two fusible elements 1′ and 4″ in ribbon form of which each has a plurality of serially related points 1*a*′ and 1*a*″, respectively, of drastically reduced cross-sectional area.

The substantially planar strip 2' of electric insulating material is arranged parallel to, and between, fusible elements 1' and 1'' and has a first plurality of arms 2a' projecting from one side of it, and a second plurality of arms 2a'' projecting from its other side. Each fusible element 1', 1'' has a plurality of equidistantly spaced points 1c' and 1c'', respectively, of large cross-sectional area. These points 1c', 1c'' are clamped against arms 2a', 2a'' by means of clamping plates 3' which are coextensive with arms 2a', 2a''. Fasteners, e.g. eyelets 4, project tranversely through arms 2a', 2a'' and through clamping plates 3'. Parts 2', 2a', 2a'', and 3' are preferably of a melamine-glass-cloth laminate for the same reasons as explained in connection with FIGS. 1–3.

It will be apparent from the above that pairs 2a', 2a'' of said first and said second plurality of arms are arranged in registry. Pairs 1a', 1a'' of said points of drastically reduced cross-sectional areas of fusible elements 1', 1'' are also arranged in registry. Each of the pairs of points 1a', 1a'' of reduced cross-sectional area is arranged between one pair 2a', 2a' of said first plurality of arms and one pair 2a'', 2a'' of said second plurality of arms.

As shown in FIGS. 1–3 strip 2 and arms 2a are an integral stamping and as shown in FIGS. 4–6 strip 2' and arms 2a', 2a'' are an integral stamping. In a possible modification of the structure of FIGS. 1–3 arms 2a might be adhesively bonded to strip 2, and in a possible modification of the structure of FIGS. 4–6 arms 2a', 2a'' might be adhesively bonded to strip 2'.

I claim as my invention.

1. A sub-assembly for manufacturing electric fuses including a. a fusible element in form of a ribbon having a plurality of serially related points of drastically reduced cross-sectional area each formed by a pair of juxtaposed substantially V-shaped incisions;

b. a substantially planar strip of electric insulating material arranged in spaced relation from, and substantially parallel to, said fusible element; and c. said strip having a plurality of arms projecting transversely therefrom and supporting said fusible element at points situated to opposite sides of pairs of said substantially V-shaped incisions.

2. A subassembly as specified in claim 1 wherein a. said strip and said plurality of arms thereof are of a melamine-glass-cloth laminate;

b. said plurality of arms are provided with plurality of substantially coextensive clamping plates; and wherein c. said fusible element is sandwiched between said plurality of arms and said plurality of clamping plates.

3. A subassembly as specified in claim 1 wherein said strip of insulating material and said plurality of arms are formed by an integral stamping.

4. A subassembly as specified in claim 1 wherein a. said strip has a first plurality of arms projecting from one side thereof and said strip has a second plurality of arms projecting from the other side thereof;

b. first fusible element in ribbon form having a plurality of pairs of juxtaposed, substantially V-shaped incisions arranged to one side of said strip and a second fusible element in ribbon form having a plurality of pairs of juxtaposed substantially V-shaped incisions arranged at the other side of said strip; and wherein c. said first plurality of arms supports said first fusible element and said second plurality of arms supports said second fusible element.

5. A sub-assembly as specified in claim 4 wherein a. pairs of said first and said second plurality of arms are arranged in registry; and b. pairs of said juxtaposed substantially V-shaped incisions of said first fusible element and of said second fusible element are arranged in registry, each of said pairs being arranged between one of said first plurality of arms and one of said second plurality of arms.

* * * * *